United States Patent [19]

Yano

[11] Patent Number: 5,005,994

[45] Date of Patent: Apr. 9, 1991

[54] PRINTING HEAD OF WIRE-DOT IMPACT PRINTER

[75] Inventor: Akio Yano, Tokyo, Japan

[73] Assignee: Fujitsu Limited, Kawasaki, Japan

[21] Appl. No.: 323,833

[22] Filed: Mar. 15, 1989

[30] Foreign Application Priority Data

| | | | |
|---|---|---|---|
| Mar. 18, 1988 | [JP] | Japan | 63-63216 |
| Jul. 15, 1988 | [JP] | Japan | 63-175068 |
| Nov. 11, 1988 | [JP] | Japan | 63-283898 |

[51] Int. Cl.[5] ..... B41J 2/295

[52] U.S. Cl. ..... 400/124; 101/93.05

[58] Field of Search ..... 400/124; 101/93.05; 310/328

[56] References Cited

U.S. PATENT DOCUMENTS

| | | | |
|---|---|---|---|
| 4,136,978 | 1/1979 | Bellinger, Jr. et al. | 400/124 |
| 4,435,666 | 3/1984 | Fukui | 310/328 |

FOREIGN PATENT DOCUMENTS

| | | | |
|---|---|---|---|
| 0117547 | 2/1984 | European Pat. Off. . | |
| 54-22228 | 2/1979 | Japan . | |
| 54-27814 | 3/1979 | Japan . | |
| 55-51570 | 4/1980 | Japan . | |
| 55-63284 | 5/1980 | Japan . | |
| 0203566 | 6/1981 | Japan . | |
| 5814765 | 7/1981 | Japan | 400/124 |
| 57-191073 | 11/1982 | Japan . | |
| 57-193375 | 11/1982 | Japan . | |
| 5983674 | 11/1982 | Japan . | |
| 58-177376 | 10/1983 | Japan | 400/124 |
| 58-188672 | 11/1983 | Japan . | |
| 59-16767 | 1/1984 | Japan | 400/124 |
| 62-56155 | 3/1987 | Japan . | |
| 62-12613 | 4/1987 | Japan . | |
| 63-57256 | 3/1988 | Japan . | |
| 3256 | 8/1985 | PCT Int'l Appl. | 400/124 |

*Primary Examiner*—Edgar S. Burr
*Assistant Examiner*—John S. Hilten
*Attorney, Agent, or Firm*—Staas & Halsey

[57] ABSTRACT

A printing head includes a plurality of impact printing wires constituting a dot matrix and a plurality of actuators respectively corresponding to, and for selectively driving the printing members. Each actuator comprises a movable member to which a printing wire is connected, an electro-distortion device, first and second parallel resilient members and an electro-distortion device. The first resilient member is connected with the electro-distortion device between the frame and the movable member and the second resilient member is connected directly between the frame and the movable member so that the extent of longitudinal expansion and contraction of the electro-distortion device, produced by application of an electrical voltage thereto, is enlarged by the movable member and transmitted thereby to the printing wire. A third resilient member is arranged substantially perpendicularly to the first and second resilient members and connects the movable member to the frame.

15 Claims, 4 Drawing Sheets

PRINTING HEAD OF WIRE-DOT IMPACT PRINTER

BACKGROUND OF THE INVENTION

1. Field of the Invention

This invention relates to a wire-dot printer, and more particularly, to a printing head of such a printer including actuating devices for driving dot-impact wires or rods comprising, for example, electro-distortion devices. The term "electro-distortion devices" as used herein means a longitudinal-effect electroexpansive transducer in which a strain is reversibly generated by the application of an electrical actuating voltage thereto, causing same to axially, or longitudinally, expand; upon termination of the actual voltage and thus when de-energized, the transducer then compresses, or contracts, in the same, longitudinal or axial direction to its original length. Accordingly, the term "electro-distortion" as employed hereafter in identifying and characterizing the actuating devices in accordance with the present invention will be understood to encompass generically these "electroexpansive" and "electrocompressive" characteristics.

2. Description of the Related Art

Recently, high-speed wire-dot printing heads have become widely used, and accordingly, to drive dot-impact wires of rods of such a high-speed printing head, an actuating means comprising electro- or magnetic-distortion devices has been developed and used instead of the conventional electromagnet type driving elements.

For example, page 92 of "NIKKEI (Japan Economic) MECHANICAL" issued on March 12, 1984, suggests that a printing head including such electro-distortion devices is used. This electro-distortion element is formed by the following steps: preparing a plurality of green sheets made of piezo-electric ceramics, forming a metal paste film on one surface of each of the green sheets to form an inner electrode, and laminating and sintering the plurality of green sheets.

To provide a printing head using such an actuating device, a means for effectively enlarging the very small displacement of such an electro-distortion element is required.

SUMMARY OF THE INVENTION

An object of the present invention is to provide a wire-dot printer having a printing head including electro-distortion devices for driving dot-impact wires or rods, capable of effectively enlarging the very small displacements of such actuating devices so as to drive the dot-impact wires or rods.

According to the present invention, there is provided a printing head comprising: a frame; a plurality of impact printing wires constituting a wire-dot matrix; and a plurality of actuators for driving the impact printing wires, respectively; each of the actuators comprising; a movable member to which one of the impact printing wires is connected; an electro-distortion device; a first resilient member having one end connected via the electro-distortion device to the frame and the other end connected to the movable member; and a second resilient member arranged substantially parallel to the first resilient member and having one end connected to the frame and the other end connected to said movable member; so that a displacement of the electro-distortion device is enlarged by the movable member and transmitted to the impact printing wire; characterized in that a third resilient member arranged substantially perpendicular to the first and second resilient members has one end connected to the frame and the other end connected to the movable member.

In another aspect of the present invention, there is provided a printing head comprising: a frame; a plurality of impact printing wires constituting a wire-dot matrix; and plurality of actuators for driving the impact printing wires, respectively; each of the actuators comprising: a movable member to which one of the impact printing wires is connected; and an electro-distortion device having one end connected to the frame and the other end connected to the movable member for driving the movable member in such a manner that a displacement of the electro-distortion device is enlarged by the movable member and transmitted to the impact printing wire; characterized in that the respective ends of the electro-distortion device are connected to each other by a pretensioned resilient member.

In still another aspect of the present invention, there is provided a printing head comprising: a frame; a plurality of impact printing wires constituting a wire-dot matrix; and a plurality of actuators for driving the impact printing wires, respectively; each of the actuators comprising: a movable member to which one of the impact printing wires is connected; an electro-distortion device; a first resilient member having one end connected via the electro-distortion device to the frame and the other end connected to the movable member; and a second resilient member arranged substantially parallel to the first resilient member and having one end connected to the frame and the other end connected to the movable member; so that a displacement of the electro-distortion device is enlarged by the movable member and transmitted to the impact printing wire; characterized in that a restricting member is provided between the electro-distortion device and the frame for restricting the displacement of the electro-distortion device in a direction substantially perpendicular to the first and second resilient members.

DESCRIPTION OF THE PREFERRED EMBODIMENTS

Figure 1:
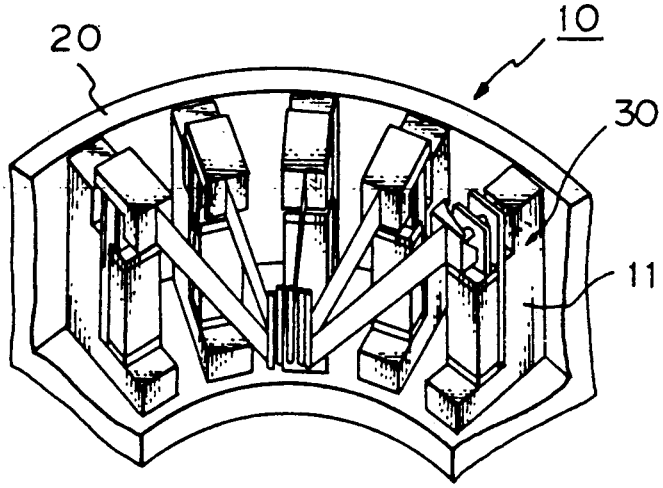
FIG. 1 is a partial perspective view of a printing head having plural actuators for driving respective dot-impact wires or rods of a printer.
Figure 2A:
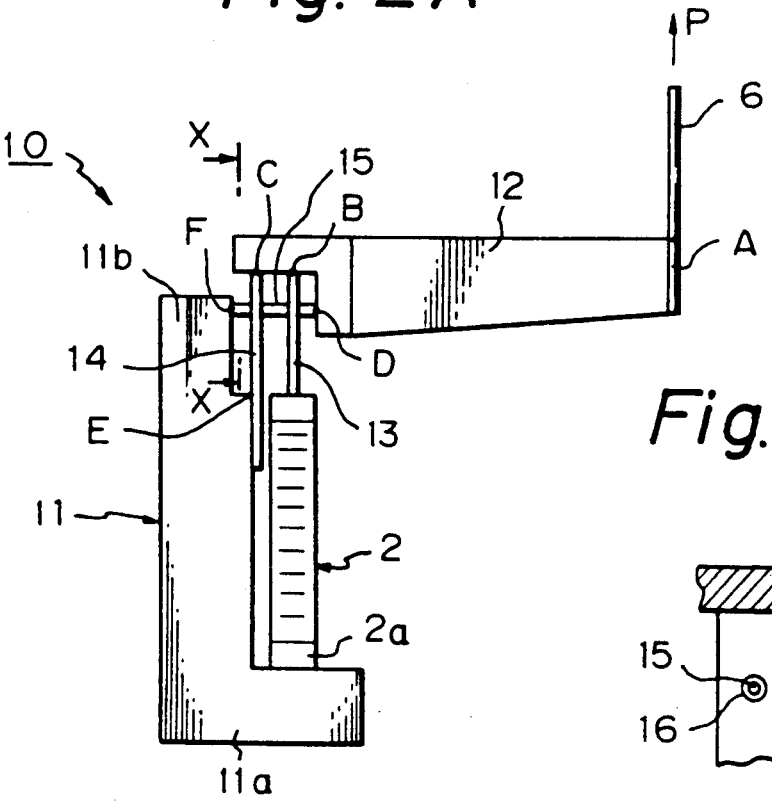
FIG. 2A is an elevational view of a first embodiment of an actuating means for driving a dot-impact wire or rod according to the present invention.
Figure 2B:
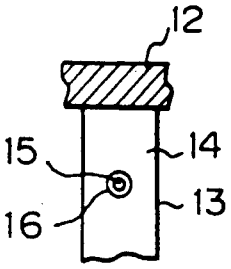
FIG. 2B is a view taken along the line X—X in FIG. 2A.

Referring now to FIGS. 1, 2A and 2B, a printing head 10 of a dot-impact printer according to the present invention is illustrated wherein the printing head 10 comprises a cylindrical housing 20 and a plurality of actuators 30 arranged radially in the cylindrical housing 20.

Each of the actuators 30 comprises an electro-distortion device 2, an impact printing wire 6, a frame 11, a movable member (or armature) 12, a first resilient member 13, a second resilient member 14, and a resilient connecting (or third resilient) member 15.

The frame 11 is substantially L-shaped, having a base 11*a* and a side wall 11*b* extending substantially perpendicular to the base 11*a*. The electro-distortion device 2, such as a piezo-electric device, has a base portion 2*a* mounted on the frame base 11*a* and, therefore, the top free end of the electro-distortion device 2 is displaced upward when electrical power is supplied to the electro-distortion device 2.

The impact printing wire 6 is fixed to an end of the movable member 12 at a position A thereof. A plurality of such printing wires 6 selectively driven by a corresponding plurality of respective actuators 30 constitute a wire-dot matrix.

The first resilient member 13 is fixedly connected at the lower end thereof to the top end of the electro-distortion device 2 and extends upward in the same direction as the displacement of the electro-distortion device 2. The first resilient member 13 is also fixedly connected at the upper end thereof to the movable member 12 at a position B thereof.

The second resilient member 14 is arranged in parallel to the first resilient member 13 and fixedly connected at the lower end thereof to the side wall 11*b* of the frame 1 at a position E. The upper end of this second resilient member 4 is fixedly connected to the movable member 12 at a position C thereof.

The distance from the first position A to the second position B is much larger than a distance from the second position B to the third position C, so that a displacement of the electro-distortion device 2 can be enlarged by the movable member 12 and transmitted to the impact printing wire 6, as will be mentioned later.

According to this embodiment, a resilient connecting (or third resilient) member 15 made of, for example, a metal wire having a circular cross-section, extends substantially perpendicular to the first and second resilient members 13 and 14 which comprise metal strips arranged in parallel to each other. The connecting wire 15 has one end fixedly connected to the movable member 12 at a position D thereof and the other end fixedly connected to the side wall 11*b* of the frame 11 at a position F thereof, and passes through respective openings 16 of the resilient members 13 and 14, as shown in FIG. 2B. The position D is located nearer the frame base 11*a* with respect to a plane on which the positions B and C lie. Also, the position F is located opposite the position D with respect to the second resilient member 14, i.e., the positions F and D are on opposite sides of the member 14.

The operations of the printing head of this embodiment according to the present invention will now be described. When printing, electrical power is supplied via a driving circuit (not shown) to the electro-distortion device 2 for a predetermined time. In this case, the upper portion of the electro-distortion device 2 is displaced upwardly and, therefore, the movable member 12 is rotated in the counterclockwise direction in FIG. 2. Accordingly, the displacement of the electro-distortion device 2 is enlarged by the movable member 12 and transmitted to the impact printing wire 6 which moves upwardly, as shown by an arrow P, to perform a dot-printing operation. After the printing operation is finished, the movable member 12 and the first and second resilient members 13 and 14 are returned to their original positions.

According to this embodiment, due to the existence of the resilient connecting member 15 passing through the first and second resilient members 13 and 14, the movements or deformations of these two resilient members 13 and 14 are restricted in such a manner that a "high dimensional deformation", as mentioned below, can be eliminated. Therefore, a stable and high-speed printing operation can be attained.

Figure 3:
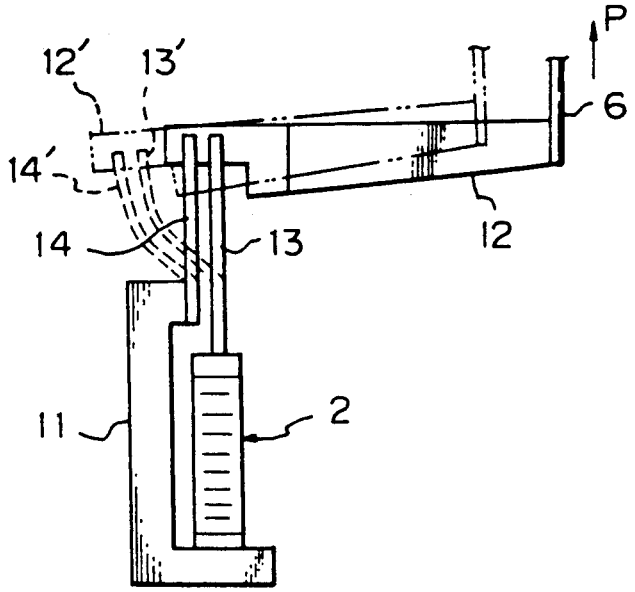
Fig. 3 (PRIOR ART)
FIG. 3 shows an example of a prior art actuator.

FIG. 3 shows a printing head known in the prior art. In this prior art, when electrical power is supplied to the electro-distortion device 2, the upper portion of the electro-distortion device 2 is displaced upwardly, and thus the first resilient member 13 is subjected to a compression force. As a result, the first and second resilient members 13 and 14 deform leftward as shown at 13' and 14', and thus the movable member 12 is turned in the counterclockwise direction as shown by a dotted line in FIG. 3. Accordingly, the impact printing wire 6 moves upward, as shown by an arrow P, to perform a dot-printing operation.

In the prior art as shown in FIG. 3, however, since there is no resilient connecting member (15) for restricting the movements of the first and second resilient members 13 and 14, these resilient members 13 and 14 deform in a "high dimensional deformation" as shown by the dotted lines 13' and 14' in FIG. 3, at the time of an impact operation by the impact printing wire 6, and this high dimensional deformation causes various problems; i.e., the printing operation is unstable and a high speed operation cannot be obtained.

Figure 4:
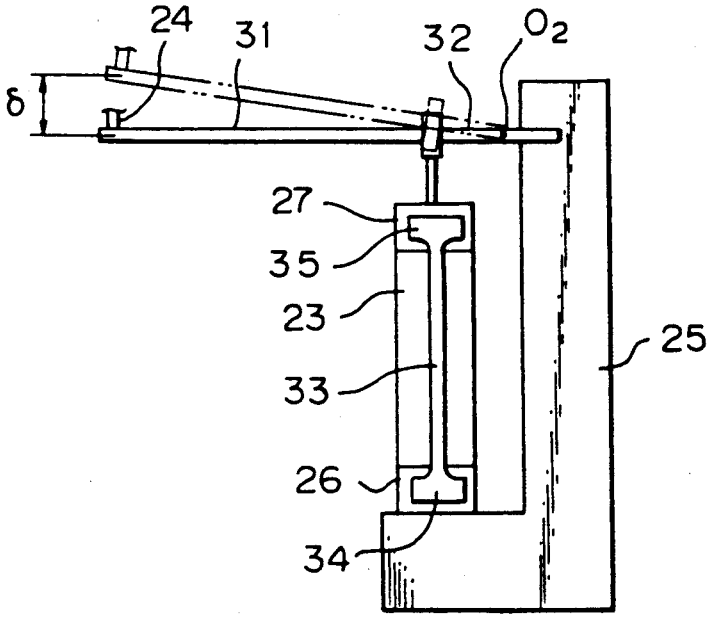
FIG. 4 is a front view of a second embodiment of an actuator for driving a dot-impact wire or rod according to the present invention.
Figure 5:
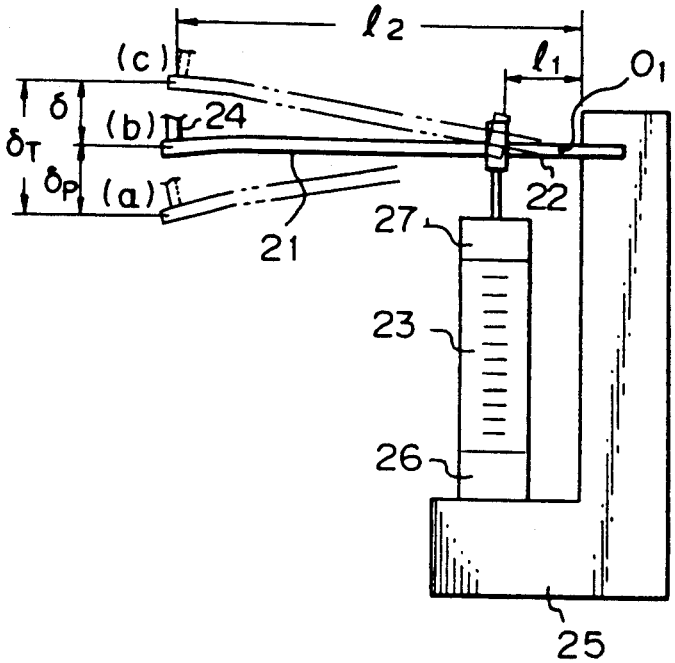
Fig. 5 (PRIOR ART)
FIG. 5 shows another example of a prior art actuator.

FIG. 4 illustrates a second embodiment of a printing head actuator according to the present invention, and FIG. 5 illustrates a corresponding prior art actuator. In FIGS. 4 and 5, the printing head includes a plurality of such actuators, each comprising a movable member 31 (21) to which an impact printing wire 24 is connected. An electro-distortion device 23 has a lower end connected to the frame 25 via a connecting member 26 and an upper end connected to a movable member 31 (21) via a connecting member 27 for driving the movable member 31 (21) in such a manner that a displacement of the electro-distortion device 23 is enlarged by the movable member 31 (21) and transmitted to the impact printing wire 24.

In the prior art as shown in FIG. 5, since the electro-distortion device 23 has a relatively weak tension strength, the movable member 21 is pretensioned in such a manner that, when the electro-distortion device 23 is not energized, the movable member 21 resiliently deforms from a position (a) indicated by a dotted line to a position (b) indicated by a solid line. In other words, a stress corresponding to an initial strain $\delta_p$ is exerted on the elastic supporting portion 22, and thus the electro-distortion device 23 is subjected to a corresponding compression force to compensate the above-mentioned drawbacks of the electro-distortion device 23. When printing, electrical power is supplied to the electro-distortion device 23 for a predetermined time. In this case, the upper portion (the connecting member 27) of the electro-distortion device 23 is displaced upward, and thus the elastic supporting portion 22 is further resiliently deformed upwardly. Accordingly, the movable member 21 is deformed by $\delta$ to a position (c) indicated by a dotted line. This affords a maximum enlargement ratio of $l_2/l_1$. The point $O_1$ is the center of rotation of the movable member 21, and thus the movable member 21 is rotated in the clockwise direction in FIG. 5 and the impact printing wire 24 is moved upwardly to conduct a dot-printing. After the printing operation is finished, the movable member 21 returns to its original position (b).

As mentioned above, in the prior art as shown in FIG. 5, during a printing operation, the elastic supporting portion 22 is subjected to a stress corresponding to the whole strain ($\delta_T=\delta_p+\delta$) of the movable member 21, which makes it difficult to reduce the size of the elastic supporting portion 22.

According to the present invention, as shown in FIG. 4, the respective, opposite ends of the electro-distortion device 23, i.e., the lower and upper connecting members 26 and 27, are connected to each other by a pretensioned resilient member 33. The resilient member 33 can be made of an elastic wire provided at the respective ends thereof with lower and upper connecting portions 34 and 35, which can be fixed to the connecting members 26 and 27 by, for example, (not shown) screws. A pair of such pretensioned resilient members 33 may be provided at both sides of the electro-distortion device 23.

Therefore, according to the present invention, a compression load is exerted on the electro-distortion device 23 due to the pretensioned resilient member 33, and thus, it is no longer necessary to exert an initial force on the elastic supporting portion 32. Therefore, it is possible to reduce the sizes of the various parts of the printing head, including the elastic supporting portion 32, and increase the inherent frequency of the movable member 31, and thus a high speed and highly reliable printing head can be obtained.

Figure 6:
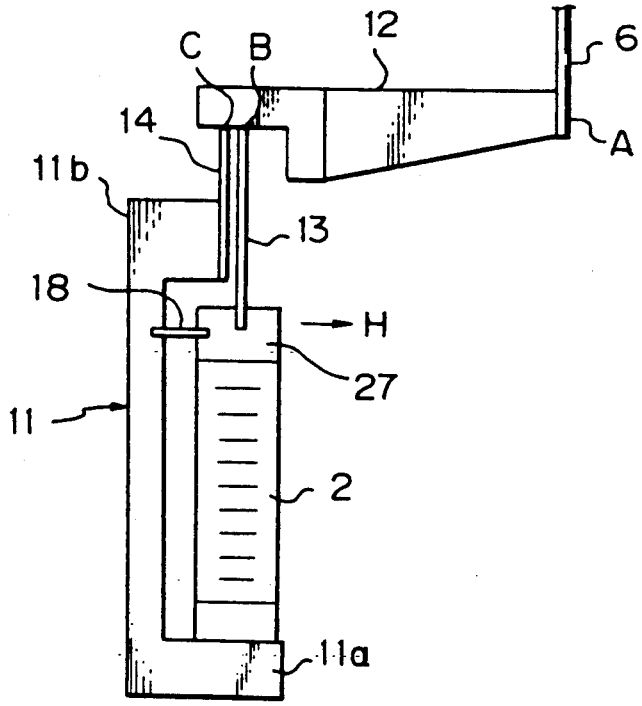
FIG. 6 is a front view of a third embodiment of the an actuator for driving a dot-impact wire or rod according to the present invention; and, FIG. 7 shows still another example of a prior art actuator.
Figure 7:
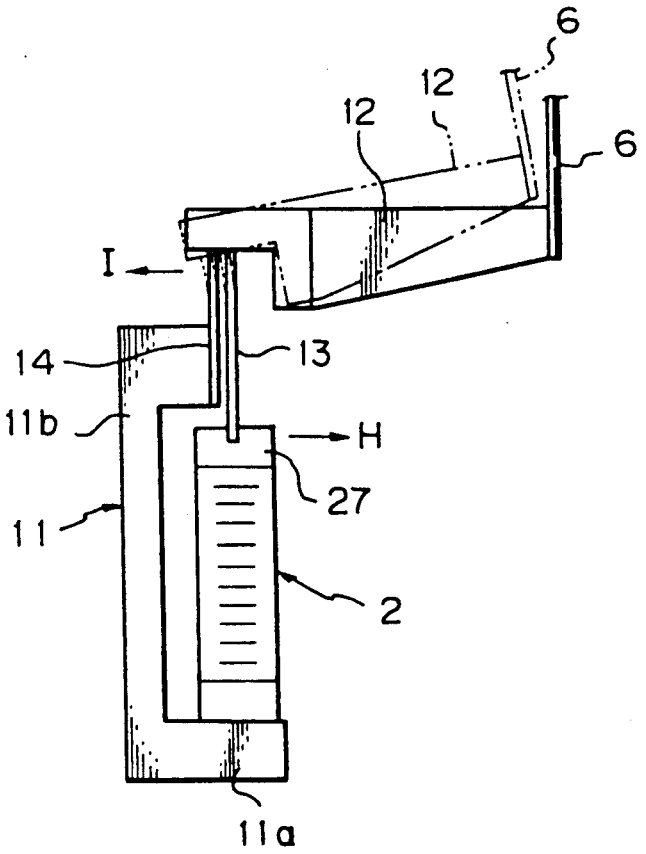
Fig. 7 (PRIOR ART)

FIG. 6 illustrates a third embodiment of a printing head according to the present invention, and FIG. 7 illustrates a corresponding prior art. The embodiment of FIG. 6 is similar to that shown in FIG. 2A and, therefore, a detailed explanation of the respective parts will be omitted, although the corresponding parts are indicated by the same reference numerals.

In the embodiment shown in FIG. 6, a restricting member 18 is provided in such a manner that one end thereof is fixedly connected to the upper portion (connecting member) 27 of the electro-distortion device 2 and the other end is fixedly connected to the side wall **11*b* of the frame 11, for restricting the displacement of the electro-distortion device 2 in a direction as shown by an arrow H substantially perpendicular to the first and second resilient members 13 and 14. The restricting member 18 comprises, for example, a metal wire extending substantially perpendicular to the direction of displacement of the electro-distortion device 2**.

According to this embodiment, a tension stress generated in the electro-distortion device 2 during a printing operation can be reduced, since the electro-distortion device 2 cannot move away from the side wall **11*b* of the frame 11**, as shown by an arrow H.

In the prior art as shown in FIG. 7, since such a restricting member (18) is not provided, when electric power is supplied to the electro-distortion device 2, the upper portion 27 of the electro-distortion device 2 is displaced upward, and thus, due to the effect similar to a bimetallic strip, the first and second resilient members 13 and 14 are deformed in the direction of arrow I as shown by dotted lines. Therefore, the movable member 12 is turned in the counterclockwise direction to a position shown by a dotted line in FIG. 7. Due to such deformation in the direction of arrow I of the first and second resilient members 13 and 14, the lower portions of these members 13 and 14 are subjected to counteractions in a direction opposite to I, as shown by an arrow H. Therefore, a bending moment is exerted on the electro-distortion device 2 to deform it in the direction of arrow H, and such a bending moment has an affect on a high speed operation of the electro-distortion device 2, and may damage the electro-distortion device 2. However, according to the embodiment shown in FIG. 6, tension stress would not be generated in the electro-distortion device 2 as mentioned above, and therefore, the electro-distortion device 2 is suitable for a high speed operation.

We claim:

1. A printing head comprising a frame, a plurality of impact printing wires constituting a wire-dot matrix and a plurality of actuators respectively corresponding to, and for selectively driving, said respective impact printing wires, each of said actuators comprising:

a movable member to which the respective one of said impact printing wires is connected;

an electro-distortion device having a first end connected to said frame and responsive to selective application of an electrical voltage thereto to undergo longitudinal expansion and contraction and a second end;

a first resilient member having a first end fixedly connected to the second end of said electro-distortion device and thereby to said frame and a second end fixedly connected to said movable member;

a second resilient member disposed in substantially parallel relationship to said first resilient member and having a first end fixedly connected to said frame and a second end fixedly connected to said movable member so that the extent of longitudinal expansion and contraction of said electro-distortion device in response to the selective application of an electrical voltage thereto is enlarged by said movable member and transmitted thereby to said impact printing wire; and a third resilient member disposed substantially perpendicularly to said first and second resilient members and having a first end fixedly connected to said frame and a second end fixedly connected to said movable member.

2. A printing head as set forth in claim 1, wherein:

said impact printing wire is connected to said movable member at a first position thereof;

said second end of said first resilient member is connected to said movable member at a second position thereof; and said second end of said second resilient member is connected to said movable member at a third position thereof, said first and third positions being disposed oppositely, relatively to said second position, so that the extent of longitudinal expansion and contraction of said electro-distortion device is enlarged by said movable member and transmitted to said impact printing wire.

3. A printing head as set forth in claim 2, wherein the distance from said first position to said second position is larger than the distance from said second position to said third position.

4. A printing head as set forth in claim 1, wherein said frame is substantially L-shaped, having a base and a side wall extending substantially perpendicular to said base, said first end of said electro-distortion device is connected to said base, and said first end of said third resilient member is connected to said side wall.

5. A printing head as set forth in claim 4, wherein said second end of said third resilient member is connected to said movable member at a fourth position thereof, said fourth position being located toward said base of said frame with respect to a plane in which the second and third positions lie.

6. A printing head as recited in claim 1, wherein:

the third resilient member is directly and fixedly connected at its first end to said frame and at its second end to said movable member.

7. A printing head as recited in claim 1, wherein:

said first and second resilient members have respective openings therein aligned in a path extending transversely to each thereof; and said third resilient member extends through the aligned openings in the first and second resilient members.

8. A printing head comprising a frame, a plurality of impact printing wires constituting a wire-dot matrix and a plurality of actuators respectively corresponding to, and for selectively driving, said respective impact printing wires, each of said actuators comprising:

a movable member to which the respective one of said impact printing wires is connected;

an electro-distortion device having a first end connected to said frame and responsive to selective application of an electrical voltage thereto to undergo longitudinal expansion and contraction;

a first resilient member having a first end connected to the second end of said electro-distortion device and thereby to said frame and a second end connected to said movable member;

a second resilient member disposed in substantially parallel relationship to said first resilient member and having a first end connected to said frame and a second end connected to said movable member so that the extent of longitudinal expansion and contraction of said electro-distortion device in response to the selective application of an electrical voltage thereto is enlarged by said movable member and transmitted thereby to said impact printing wire;

a third resilient member substantially perpendicular to said first and second resilient members and having a first end connected to said frame and a second end connected to said movable member; and said third resilient member comprises a wire, said first and second resilient member comprise respective metal strips in said substantially parallel relationship to each other and substantially perpendicular to said third resilient member, and each said strip has an opening therein through which said third resilient member passes.

9. A printing head comprising a frame, a plurality of impact printing wires constituting a wire-dot matrix and a plurality of actuators respectively corresponding to, and for selectively driving, said respective impact printing wires, each of said actuators comprising:

an elastic movable member having a first, free end to which a respective said impact printing wire is connected and a second, opposite end rigidly connected to said frame;

an electro-distortion device responsive to selective application of an electrical voltage thereto to undergo longitudinal expansion and contraction, said electro-distortion device having a first end connected to said frame and a second, opposite end connected to said elastic movable member for driving said movable member from a normal, rest position to an actuated position and in such a manner that the extent of longitudinal expansion of said electro-distortion device in response to the selective application of an electrical voltage thereto, and the subsequent contraction thereof upon termination of the applied electrical voltage, is enlarged by said movable member and transmitted thereby to said impact printing wire; and a resilient member having first and second, opposite ends connected respectively and directly to said first and second ends of said electro-distortion device, said resilient member being pretensioned for opposing the longitudinal expansion of, and thus the direction of driving of said movable member to said actuated position by said electro-distortion device and, correspondingly, for supporting the contraction of the electro-distortion device, and thus for returning said elastic movable member to said rest position, upon termination of said application of an electrical voltage to said electro-distortion device.

10. A printing head as set forth in claim 9, wherein said resilient means comprise first and second resilient members disposed on respective, opposite sides of said electro-distortion device.

11. A printing head comprising a frame, a plurality of impact printing wires constituting a wire-dot matrix and a plurality of actuators respectively corresponding to, and for selectively driving, said respective impact printing wires, each of said actuators comprising:

a movable member to which the respective one of said impact printing wires is connected;

an electro-distortion device having a first end connected to said frame and responsive to selective application of an electrical voltage thereto to undergo longitudinal expansion and contraction;

a first resilient member having a first end connected to the second end of said electro-distortion device and thereby to said frame and a second end connected to a movable member;

a second resilient member disposed in substantially parallel relationship to said first resilient member and having a first end connected to said frame and a second end connected to said movable member so that the extent of longitudinal expansion and contraction of said electro-distortion device in response to the selective application of an electrical voltage thereto is enlarged by said movable member and transmitted thereby to said impact printing wire; and a restricting member, having first and second, opposite ends, extending transversely to said first and second resilient members and fixedly connected at the first end to said electro-distortion device and at the second, opposite end to said frame and thereby extending therebetween and restricting said electro-distortion device from displacement away from said frame in a direction substantially perpendicular to said first and second resilient members.

12. A printing head as set forth in claim 11, wherein said frame is substantially L-shaped having a base and a side wall extending substantially perpendicular to said base, said electro-distortion device has one end connected to said base and the other end connected to said first resilient member, and said restricting member has one end connected to said side wall and the other end connected to said electro-distortion device in the vicinity of the other end thereof.

13. A printing head as set forth in claim 11, wherein:

said impact printing wire is connected to said movable member at a first position thereof;

said second end of said first resilient member is connected to said movable member at a second position thereof; and said second end of said second resilient member is connected to said movable member at a third position thereof, said first and third positions being disposed oppositely, relatively to said second position, so that the extent of longitudinal expansion and contraction of said electro-distortion device is enlarged by said movable member and transmitted to said impact printing wire.

14. A printing head as set forth in claim 13, wherein a distance from said first position to said second position is larger than a distance from said second position to said third position.

15. A printing head comprising a frame, a plurality of impact printing wires constituting a wire-dot matrix and a plurality of actuators respectively corresponding to, and for selectively driving, said respective impact printing wires, each of said actuators comprising:

a movable member to which the respective one of said impact printing wires is connected;

an electro-distortion device having a first end connected to said frame and responsive to selective application of an electrical voltage thereto to undergo longitudinal expansion and contraction;

a first resilient member having a first end connected to the second end of said electro-distortion device and thereby to said frame and a second end connected to said movable member;

a second resilient member disposed in substantially parallel relationship to said first resilient member and having a first end connected to said frame and a second end connected to said movable member so that the extent of longitudinal expansion and contraction of said electro-distortion device in response to the selective application of an electrical voltage thereto is enlarged by said movable member and transmitted thereby to said impact printing wire; and a restricting member connected between said electro-distortion device and said frame for restricting said electro-distortion device from displacement in a direction substantially perpendicular to said first and second resilient members, said restriction member comprising a metal wire.

* * * * *

UNITED STATES PATENT AND TRADEMARK OFFICE

CERTIFICATE OF CORRECTION

PATENT NO. : 5,005,994

DATED : April 9, 1991

INVENTOR(S) : Akio YANO

It is certified that error appears in the above-identified patent and that said Letters Patent is hereby corrected as shown below:

Col. 6, line 8, change "affect" to --effect--.

Col. 8, line 44, change "a" to --said--.

Signed and Sealed this

Twenty-sixth Day of October, 1993

*Attest:*

*Attesting Officer*

BRUCE LEHMAN

*Commissioner of Patents and Trademarks*